United States Patent [19]

Godfrey

[11] 4,433,811

[45] Feb. 28, 1984

[54] FLOW CONTROLLER

[75] Inventor: Thomas E. Godfrey, Moore, S.C.

[73] Assignee: Milliken Research Corporation, Spartanburg, S.C.

[21] Appl. No.: 434,793

[22] Filed: Oct. 18, 1922

Related U.S. Application Data

[62] Division of Ser. No. 258,410, Apr. 28, 1981, abandoned.

[51] Int. Cl.[3] ..... B05B 12/10

[52] U.S. Cl. ..... 239/74; 239/533.1; 239/562

[58] Field of Search ..... 239/67, 68, 533.1, 570; 73/202, 562, 74, 75

[56] References Cited

U.S. PATENT DOCUMENTS 4,294,277 10/1981 Szelisa ..... 239/68 X

*Primary Examiner*—John J. Love

*Attorney, Agent, or Firm*—Earle R. Marden; H. William Petry

[57] ABSTRACT

Apparatus for the application of liquids to moving material, such as patterned application of dyes to moving textile material, including a liquid applicator positioned above the material path of travel for continuously discharging liquid in a row of plural streams downwardly onto the material, means for selectively deflecting selected of the continuously flowing streams in accordance with a pattern control device, and collection means for receiving the deflected liquid to prevent its contact with the moving material. The apparatus includes a novel flow controller to measure the flow rate of the plural streams from a dye manifold and in response thereto to adjust the flow of dye liquid from the manifold, by opening and closing a valve located in the return conduit from the dye manifold to the dye supply tank.

5 Claims, 4 Drawing Figures

FLOW CONTROLLER

This is a division of application Ser. No. 258,410, filed Apr. 28, 1981, now abandoned.

The present invention is directed to apparatus for applying liquids to moving materials and, more particularly, to an improved apparatus for the patterned application of dye or other liquids to moving textile materials, such as pile carpets, fabrics and the like.

It is known to apply liquid dyes to moving textile materials from plural streams which are directed onto the materials and selectively controlled to produce a desired pattern thereon. McElveen, U.S. Pat. No. 3,393,411, describes apparatus and process wherein plural streams of dye are selectively controlled in their flow to provide a distinct pattern on a pile carpet.

U.S. Pat. Nos. 3,443,878 and 3,570,275 describe apparatus and process for the patterned dyeing of a moving textile web wherein continuously flowing streams of dye normally directed in paths to impinge upon the web are selectively deflected from contact with the web in accordance with pattern information. The webs are thus dyed in a desired pattern and the deflected dye is collected and recirculated for use.

In such continuous flow, deflection-type dyeing apparatus, it is known to position a plurality of dye applicators, or "dye gun bars", generally above the path of movement of a material to be dyed and wherein each of the gun bars extends across the path of material movement and is provided with a row of dye outlets which project streams of dye downwardly toward the material to be dyed. Each continuously flowing dye stream is selectively deflected by a stream of air which is discharged, in accordance with pattern information, from an air outlet located adjacent each dye discharge outlet. The air outlet is positioned to direct the air stream into intersecting relation with the dye stream and to deflect the dye into a collection chamber or trough for recirculation . To accurately control the amount of dye applied to a given location on the material during the dyeing operation, and to insure that the dye strikes the material in a very small, precise spot, the lower portion of the collection chamber contains a collector plate supportably positioned in spaced relation above the lower wall of the collection chamber. This collector plate is adjustably attached to the lower wall so that its edge can be accurately positioned relative to the dye discharge axes of the gun bar to insure prompt and precise interception of the streams when deflected. Details of such a dyeing apparatus and collection chamber construction are described and claimed in commonly assigned Klein, U.S. patent application Ser. No. 471,111, filed May 17, 1974, now U.S. Pat. No. 3,942,343.

As described in said application, each dye stream, when deflected, passes across the edge of the collector plate and into the collection chamber. Upon removal of deflection from the stream, the stream moves back across the plate edge and resumes its normal path of travel toward the material to be dyed.

In apparatus of this type, the dye liquids are considered to be non-Newtonian fluids due to the addition of thickeners and/or resins to the dye liquid. As is well known, non-Newtonian liquids do not conform to the basic rules of fluid mechanics as applied to water and air. Therefore, the disclosed invention involves the use of an improved flow controller to sense the jet flow rate of the dye liquid and in response to such measurement to adjust the flow of the dye liquid from the manifold in order to maintain a pre-determined flow of dye liquid through the dye jets independent of fluid viscosity.

Therefore, it is an object of the invention to provide a new and improved meter to sense the jet flow rate of a non-Newtonian fluid in order to control the flow of such fluid from a dye jet device.

The invention will be better understood and further explained by reference to the accompanying drawings, in which.

Figures 1, 2:
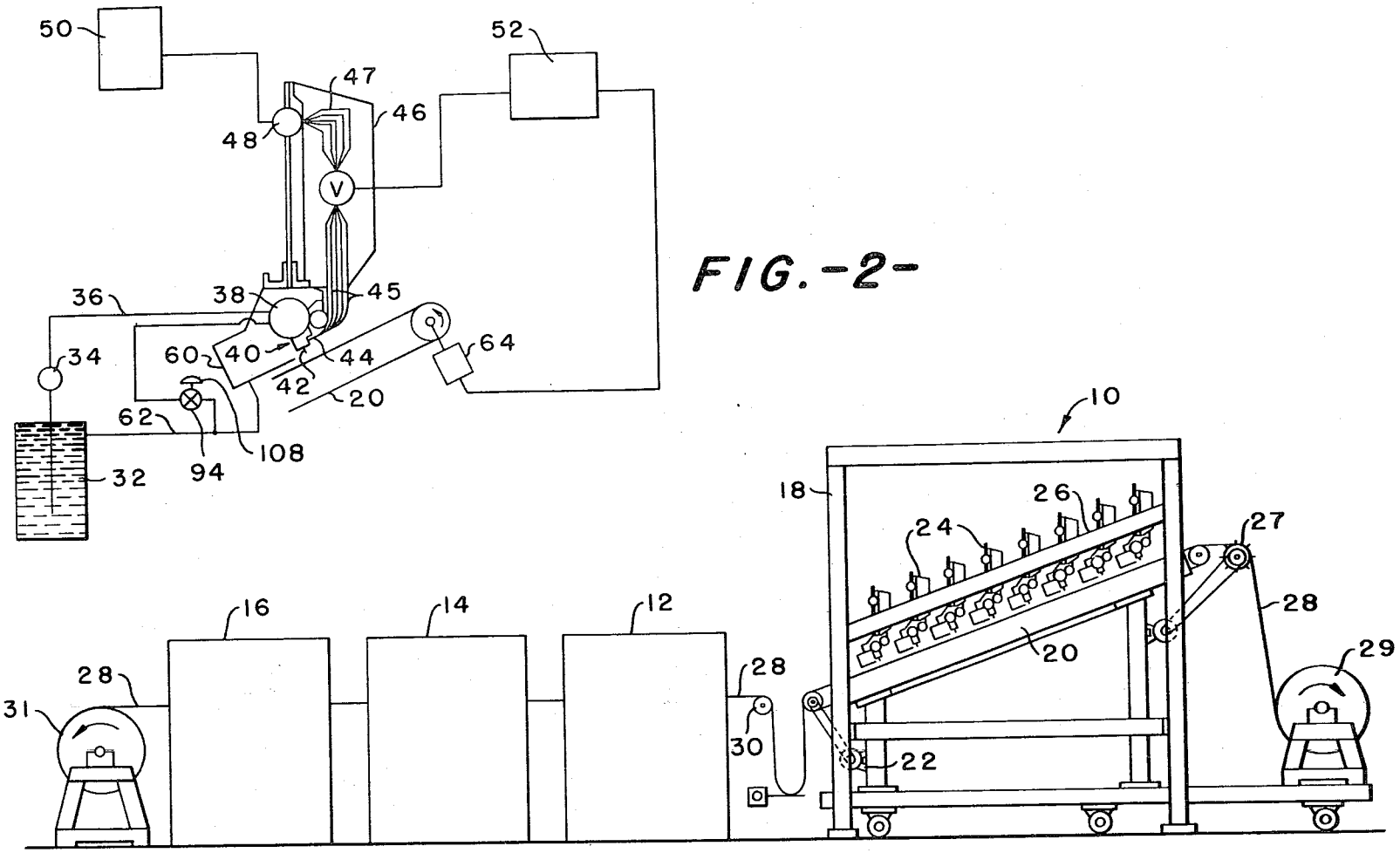
FIG. 1 is a schematic side elevation of apparatus for dyeing a moving material.
FIG. 2 is a schematic drawing of a single dye applicator, or gun bar, of the apparatus of FIG. 1 and shows a basic arrangement for supplying dye to and from, and air under pressure to, each of the gun bars, together with control means for programming the same.

Referring more specifically to the drawings, FIG. 1 shows, in schematic side elevation, apparatus for applying liquids to a moving material to which the present invention pertains. As shown and as will be described, the apparatus is particularly adapted for the patterned application of dyes to a moving length of pile carpet material; however, it is to be understood that the liquid applicator of the apparatus could be employed to apply various types of liquids to various moving materials in a programmed manner.

The dyeing apparatus shown generally comprises a dye applicator section 10, a steam chamber 12, a washer 14, and a dryer 16. The dye applicator section 10 is composed of a main frame 18 supporting an inclined conveyor 20 which is driven by motor means 22. Positioned above and spaced along the length of the conveyor are plurality of dye applicator members, or gun bars 24, (8 being shown), which extend in parallel, spaced relation across the width of the conveyor and are suitably supported at their ends by attachment to diagonal frame members (one of which, 26, is shown) on either side of the conveyor. For pattern dyeing broadloom carpets, the conveyor conveniently may be 12 to 15 feet in width and the gun bars 24 each are provided with a different color dye to apply a colored pattern to the carpet.

In operation, a length of carpet 28 is continuously withdrawn from a supply roll 29 by a driven pinroller 27 and delivered to the inclined conveyor 20 which transports the carpet beneath the gun bars 24. Each gun bar is provided with a different colored liquid dye which is dispensed in streams from orifices or outlets spaced along the gun bar onto the carpet as it passes through the applicator section 10. Details of the construction and control of gun bars will be explained hereinafter. Dyed carpet leaving conveyor 20 is directed by suitable support means, such as guide rollers, one of which 30 is shown, through the steam chamber 12, the washer 14, and the dryer 16 where the dyed carpet is treated in conventional manner to fix the dye, remove excess dye, and dry the dyed carpet, respectively. Details of the dye-fixing steam chamber 12, washer 14, and dryer 16 do not form part of the present invention and apparatus for performing such conventional practices are well known in the art. The dyed carpet is collected on a collection roll 31.

The gun bars 24 are of substantially identical construction and the details of their construction and operation can better be described by reference to FIGS. 2 and 3. As seen in FIG. 2, which is a schematic side elevation of a gun bar 24, each gun bar is provided with a separate dye reservoir tank 32 which supplies liquid dye, by means of pump 34 and conduit means 36, under pressure to a dye manifold pipe 38 of the gun bar. Pipe 38 communicates at suitable locations along its length with a sub-manifold section 40 attached to the pipe. The manifold pipe 38 and submanifold section 40 extend across the width of the conveyor 20 and sub-manifold section 40 is provided with a plurality of dye outlets 42 spaced along its length to continuously discharge a row of parallel dye streams downwardly toward the material to be dyed.

Positioned adjacent and at about a right angle to each dye outlet 42 of sub-manifold section 40 is an outlet of an air supply tube 44. Each air tube communicates by way of a conduit or tube 45 with a separate valve, illustrated collectively by the symbol V, located in a valve support box 46 of the gun bar. Each valve is, in turn, connected by a conduit or tube 47 to an air supply manifold 48 which is provided with pressurized air by a compressor 50. Each of the valves V, which may be of the electromagnetic solenoid type, are individually controlled by electrical signals from a pattern control device 52. The air outlets of tubes 44 provide streams of air to impinge at approximately right angles against the continuously flowing dye streams from the dye outlets 42 and deflect the same into a collection chamber or trough 60 from which liquid dye is removed, by way of suitable conduit means 62, to dye reservoir tank 32 for recirculation.

The pattern control device 52 for operating the solenoid valves may be composed of various type pattern control means, such as a computer with magnetic tape transport for pattern information storage. Desired pattern information from control device 52 is transmitted to the solenoid valves of each gun bar at appropriate times in response to conveyor movement which is transmitted by suitable transducer means 64 operatively connecting the conveyor 20 and pattern control device 52.

In a typical dyeing operation utilizing the presently disclosed apparatus, when no pattern information is supplied to the air valves of the gun bars from the control device 52, the valves remain "open" to permit passage of pressurized air through supply tubes 44 to continuously deflect all of the continuously flowing dye streams from the gun bar outlets 42 into the collection trough 60 for recirculation. When carpet to be dyed passes beneath the first gun bar of the dye applicator section 10, pattern control device 52 is actuated in suitable manner, such as manually by an operator. Thereafter, signals from transducer 64 release pattern information from device 52 to selectively "close" the air valves so that the corresponding dye streams are not deflected, but pass in their normal discharge paths to strike the carpet. Thus, by operating the solenoid air valves of each gun bar in the desired pattern sequence, a colored pattern of dye is placed on the carpet during its passage through the dye applicator section 10.

Figure 3:
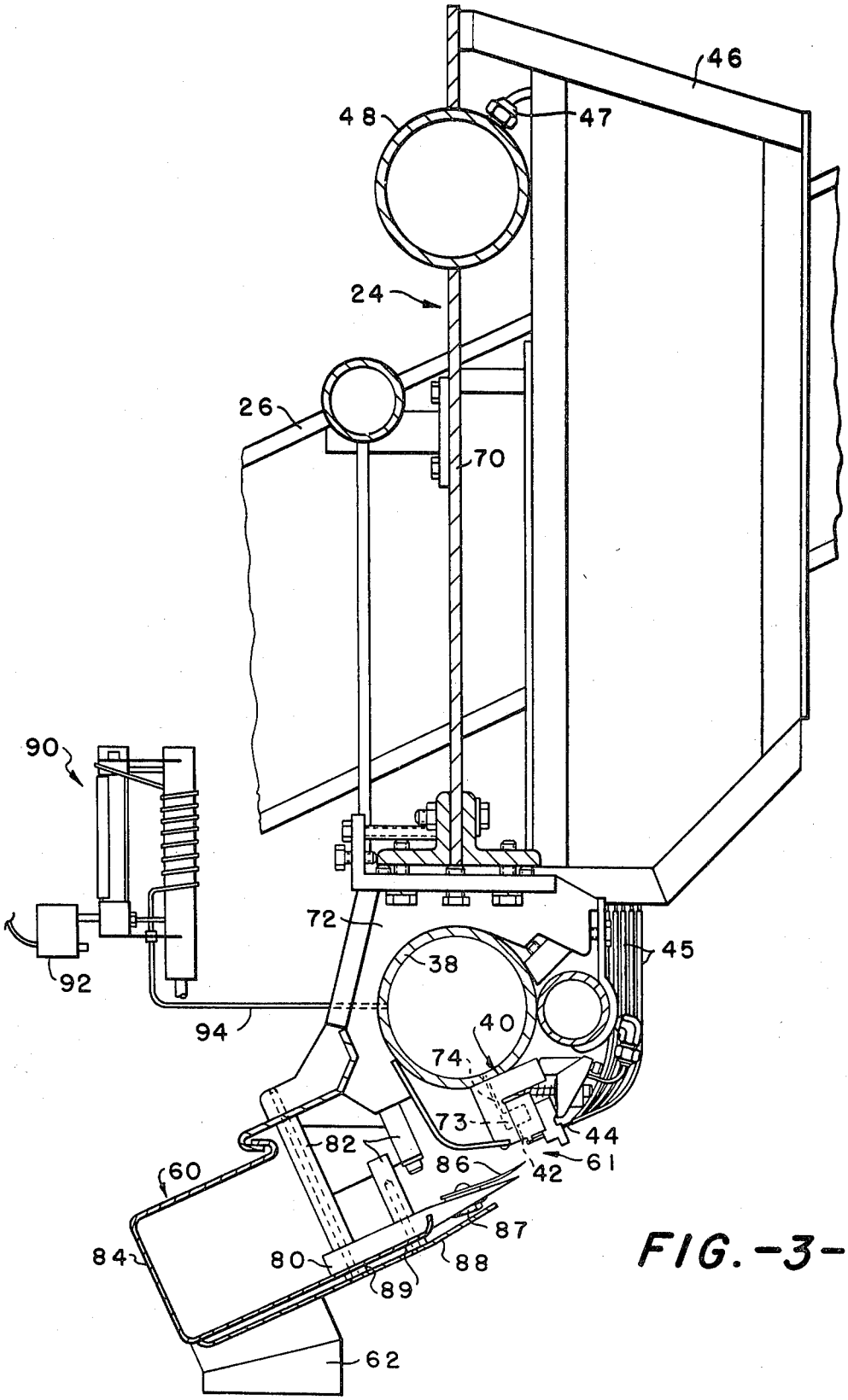
FIG. 3 is an enlarged side view, partially in section, of a gun bar of the apparatus of the present invention ,and showing in more detail the positional arrangement of the dye applicator section and dye collection chamber of the gun bar.

Details of the construction of each gun bar are best shown in FIG. 3 which is an end elevation view, partially in section, of one of the gun bars 24. As seen, each gun bar includes a main structural support plate 70 which extends across the full width of the conveyor and is supportably attached to the diagonal members of the support frame 18. Attached to the upper portion of plate 70 is the air supply manifold 48 and adjustably attached to the lower flanged edge of the plate, by suitable bracket and clamp means 72, which are spaced along the length of plate 70, is the dye manifold pipe 38. Sub-manifold section 40 is suitably attached, as by bolts (not shown), to dye manifold pipe 38 and has a sub-manifold chamber 73 which communicates by way of a plurality of passageways 74 spaced along pipe 38 with an interior chamber of manifold pipe 38 which receive dye therefrom. The dye receiving chamber 73 of sub-manifold section 40 is provided with the plurality of dye discharge outlets 42 which are spaced along the length of sub-manifold section 40 and across the width of the conveyor to discharge dye in a row of parallel streams onto the moving carpet.

Details of the construction and arrangement of the dye collection trough or chamber of the present invention may be best described by reference to FIG. 3. The collection chamber 60 includes a relatively thick, rigid main support plate, or bar 80 which extends the entire length of the gun bar and is attached thereto at spaced locations along the length of the gun bar by rod members 82 connecting plate 80 to the clamping means 72. To provide positional stability for the collection chamber, the support plate 80 is formed of a high strength material, such as a relatively thick stainless steel plate.

The outer walls 84 of the collection chamber are conveniently formed of a thin, lightweight material, such as stainless steel sheet metal, attached in suitable manner to support plate 80 and clamping means 72 of the gun bar (FIG. 3). The outer edge portion of plate 80 is suitably tapered, as shown, to form a sharp edge which extends generally parallel to the row of dye outlets 42 of the gun bar. The support plate 80 also serves as a secondary dye collector, as will be explained.

Supportably positioned in spaced relation above the upper surface of the tapered portion of support plate 80 is a first, or primary dye collector plate 86 which extends the length of the gun bar and has a sharp outer edge positioned closely adjacent and parallel to the row of discharge outlets of the gun bar. The primary collector plate 86 is adjustably attached, as by bolt and spacer means 87, at spaced locations along its length to the upper surface of support plate 80 so that the plate 86 may be moved to position its outer edge relative to the dye discharge axes of the dye outlets. Various fastening means may be employed for adjustably mounting the primary collector plate and one such means is disclosed in previously referred to Klein, U.S. patent application Ser. No. 471,111, filed May 17, 1974, now U.S. Pat. No. 3,942,343.

Supportably attached, as by screw and spacer means 89, in spaced relation below the support plate 80 is a third dye collector plate 88, the outer edge of which extends generally parallel to the outer edges of plate 80 and 86 and is located at a further distance from the discharge axes of the dye outlets of the gun bar than these two edges. In the embodiment shown in FIG. 3, the third collector plate 88 does not communicate directly with the interior of the dye collection chamber, but extends in spaced relation below the collection chamber throughout its length to points beyond both sides of the conveyor so that dye collected by the third collector plate may drain from the open sides of the collector plate without striking the moving carpet being dyed.

As seen, the collection chamber 60 has an elongate opening or entrance 61 for the reception of deflected dye. The opening extends the length of the gun bar and is located on the opposite side of the discharge axes D (FIG. 4) of the dye outlets 42 from the air supply tubes 44. The dye deflected by streams of air from the air supply tubes passes into the opening of the dye collection chamber and flows by gravity into the lower interior portion of the chamber. The collected dye is removed, as by gravity, from the collection chamber through one or more drain lines 62, which direct the dye back to the dye reservoir 38 for recirculation.

Figure 4:
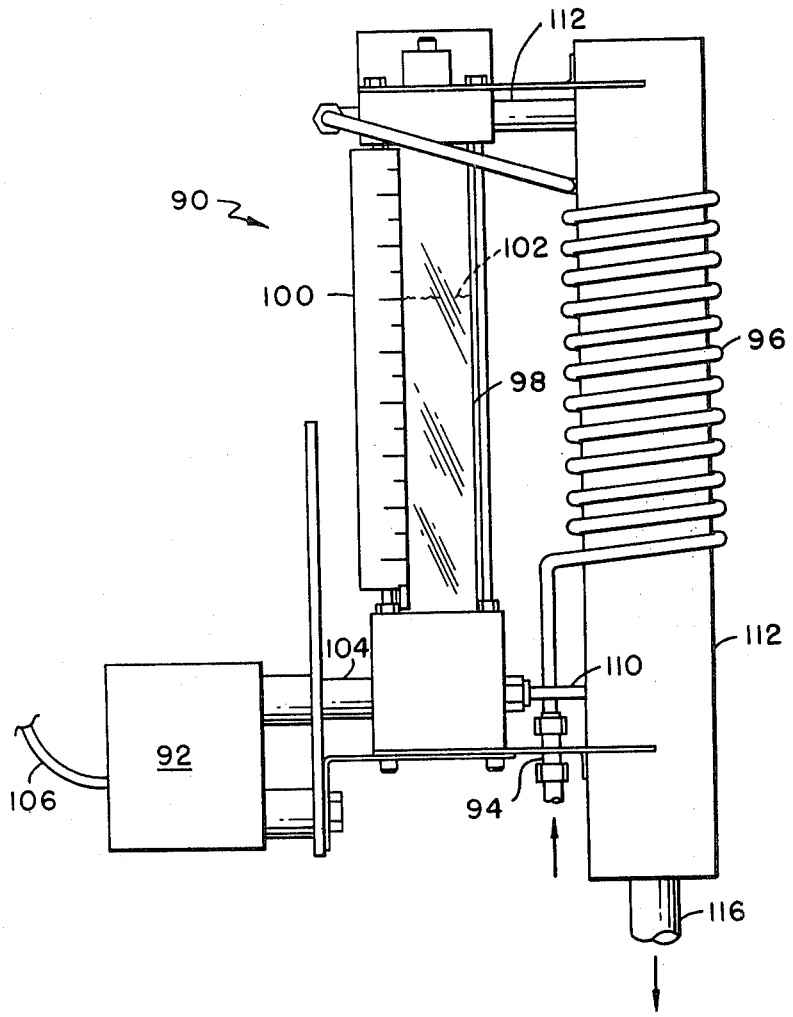
FIG. 4 is an enlarged, detailed plan view of the meter shown schematically in FIG. 3.

In FIGS. 3 and 4 the reference numeral 90 represents a meter which senses the flow rate of the dye fluid from the dye jets by measuring a head pressure and through the pressure transducer 92 controls the opening or closing of the flow valve 94. The flow controller 90 receives dye fluid from the manifold 38 through the inlet connection 94 of the spiral wound capillary tube 96. From the tube 96 the dye fluid passes into the glass column 98 and maintains a certain level which is proportional to the dye jet flow rate and is read on the scale 100. The pressure equivalent to the height of the column 102 is transmitted through tube 104 to the pressure transducer 92 where the pressure is converted to an electrical signal transmitted by wires 106 to the controller 108 of the valve 94 in the conduit means 36. The length of the tube 96 is so selected and the scale 100 so calibrated that the height of the column 102 provides an indirect reading of jet flow rate. Obviously, the purpose of the controller 90 is to maintain a predetermined flow from the dye jet 42. To this end it has been found that there is a critical length of the exit tube 110 from the main body of the meter into the receiver 112. This length is determined experimentally by maintaining the height of the column 102 constant for a selected jet 42 and selecting a length of tube which will maintain the jet flow rate from the jet within $\pm 1\frac{1}{2}\%$ of the desired jet flow rate independently of the viscosity fluctuation of the fluid. This length is determined by trial and error. The diameter of the exit tube 110 is substantially the same as the diameter of the capillary tube 96.

The receiver 112 is under atmospheric pressure and receives dye fluid from the exit tube 110 as well as the overflow tube 114 and delivers same via conduit 116 back to the dye reservoir tank 32 for recirculation.

It can be seen that a meter has been provided which will automatically adjust the flow rate from a dye jet machine by measuring a pressure change in the dye manifold. The disclosed invention is primarily useful on apparatus employing non-Newtonian fluids such as dye liquids having thickeners and resins therein which cause the composite fluid to act like a non-Newtonian fluid.

Although I have described in detail the preferred embodiment of the invention, it is contemplated that changes may be made without departing from the scope or spirit of the invention and I desire to be limited only by the scope of the claims.

I claim:

1. Apparatus for controlling the flow rate of a non-Newtonian fluid from a fluid jet comprising: a fluid jet, manifold means supplying a non-Newtonian fluid to said jet, means supplying non-Newtonian fluid to said manifold means, control means to control the flow of non-Newtonian fluid from said manifold means and pressure sensitive means operably associated with said manifold means to automatically cause said control means to adjust the flow of fluid from said manifold means upon a change of flow rate from the jet, said control means including an elongated chamber for the non-Newtonian fluid, an inlet tube operably associated with the fluid pressure in said manifold means, a capillary tube connected at one end to said inlet tube and to said chamber at the other end and an outlet tube in communication with said means to supply the non-Newtonian fluid, said outlet tube, said capillary tube and said inlet tube having substantially the same diameter.

2. The apparatus of claim 1 wherein said capillary tube is spirally wound.

3. The apparatus of claim 1 wherein said outlet tube has a length to maintain the flow-rate from said fluid jet within $\pm 1\frac{1}{2}\%$ independent of the viscosity of the non-Newtonian fluid.

4. The apparatus of claim 3 wherein said capillary tube is spirally wound.

5. The apparatus of claim 4 wherein said sensing means includes a pressure transducer in communication with said chamber.

* * * * *

UNITED STATES PATENT AND TRADEMARK OFFICE

CERTIFICATE OF CORRECTION

PATENT NO. : 4,433,811

DATED : February 28, 1984

INVENTOR(S) : Thomas E. Godfrey

It is certified that error appears in the above-identified patent and that said Letters Patent is hereby corrected as shown below:

Front Page, Item [22], "October 18, 1922" should be --October 18, 1982--.

Front Page, Item [62], delete "abandoned" and insert --U. S. Patent No. 4,392,366--.

Column 1, line 5, delete "now abandoned" and insert --now U. S. Patent No. 4,392,366, granted July 12, 1983--.

Signed and Sealed this

*Tenth* Day of *July 1984*

[SEAL]

*Attest:*

GERALD J. MOSSINGHOFF

*Attesting Officer*

*Commissioner of Patents and Trademarks*